United States Patent [19]

Pariseau et al.

[11] 4,366,694

[45] Jan. 4, 1983

[54] COMPACT ROLLING MILL

[75] Inventors: David L. Pariseau, Southbridge; Philip Wykes, Worcester, both of Mass.

[73] Assignee: Morgan Construction Company, Worchester, Mass.

[21] Appl. No.: 188,072

[22] Filed: Sep. 17, 1980

[51] Int. Cl.[3] ..... B21B 13/08

[52] U.S. Cl. ..... 72/235; 72/238

[58] Field of Search ..... 72/234, 235, 237, 238, 72/239

[56] References Cited

U.S. PATENT DOCUMENTS

| | | | |
|---|---|---|---|
| 2,089,311 | 8/1937 | Tolles | 72/237 |
| 3,298,214 | 1/1967 | Stubbs et al. | 72/235 |
| 3,306,090 | 2/1967 | VomDorp et al. | 72/239 |

FOREIGN PATENT DOCUMENTS

| | | |
|---|---|---|
| 466234 | 5/1937 | United Kingdom . |
| 509361 | 7/1939 | United Kingdom . |
| 1376759 | 12/1974 | United Kingdom . |
| 1422723 | 1/1976 | United Kingdom . |

*Primary Examiner*—Lowell A. Larson

*Attorney, Agent, or Firm*—Thompson, Birch, Gauthier & Samuels

[57] ABSTRACT

A compact rolling mill has a housing structure divided into a plurality of rolling bays by rigidly interconnected posts extending transversally across the rolling line. Each rolling bay has a window facing a common side of the mill. The rolling bays are adapted to contain roll packages, with each such package including a pair of work rolls straddle mounted between bearings arranged in bearing chocks. The roll packages are movable, either singly or as a group, in a common lateral direction through the windows, between operative rolling positions supported by the housing posts within the rolling bays, and extracted inoperative positions on the aforesaid common side of the mill.

15 Claims, 13 Drawing Figures

COMPACT ROLLING MILL

BACKGROUND OF THE INVENTION

This invention relates generally to single strand continuous rolling mills for billets, bars and the like, having straddle-mounted work rolls arranged in pairs along the rolling line, with the axes of successive work roll pairs being angularly offset to eliminate product twisting.

Rolling mills of this general type have been known for many years, as evidenced for example by U.S. Pat. Nos. 113,708 (Tranter et al) and 1,858,990 (Foren), and by German Pat. No. 742,990 (Wegner). In these prior art mills, the work roll pairs are each contained in separate housings which are mounted in spaced relationship along the rolling line, thus occupying a considerable amount of mill floor space. Moreover, when a roll change is required, the separate housings either must be dismantled while on the rolling line, or replaced entirely by spare housings containing other work rolls. The former alternative results in prolonged and costly mill down time, whereas the latter alternative requires a considerable capital investment in spare parts.

There are also multi-strand rolling mills of the type shown in U.S. Pat. No. 3,675,456 (Sieurin) which incorporate transfer devices for laterally shifting roll packages into and out of a succession of horizontal roll housings. Here again, however, the roll housings are separate structures spaced at considerable distances from each other along the rolling line.

The present invention represents a somewhat radical departure from conventional practice, with one of its principal objectives being the provision of an extremely compact single strand continuous rolling mill having a plurality of roll packages, each including pairs of work rolls straddle-mounted between bearing chocks, with the roll axes of successive roll packages being arranged at 90° relative to each other. Compactness is made possible to a large extent by containing the roll packages in closely spaced relationship within a unitary housing structure.

Another object of the present invention is the provision of a compact rolling mill of the above-described type having means for transferring the roll packages in a common lateral direction between operative rolling positions contained within the unitary housing structure, and extracted inoperative positions on one side thereof.

A further object of the present invention is the provision of means for accommodating the aforesaid lateral extraction of roll packages either singly or as a group, and with or without a stalled product length threaded therethrough.

SUMMARY OF THE INVENTION

A rolling mill in accordance with the present invention has a stationary housing structure with a plurality of posts extending transversally across and spaced along the rolling line. Openings in the posts are aligned with the rolling line to accommodate passage of the product being rolled. The posts are rigidly interconnected by bridging members which cooperate therewith in defining a plurality of rolling bays with open windows facing one side of the mill.

A plurality of roll packages are adapted for location in the rolling bays in operative rolling positions supported between the posts. Each roll package includes a pair of work rolls rotatably supported between the bearings contained in bearing chocks, and the roll axes of successive roll packages are arranged at 90° relative to each other. The work rolls may be spindle-driven in a generally conventional manner.

Transfer carriages are employed to shift the roll packages through the housing windows in a common lateral direction between their operative rolling positions and inoperative extracted positions located on one side of the housing structure.

In order to further strengthen the housing structure, additional bridging members extend across the windows of selected rolling bays. The additional bridging members are detachably engaged to the posts defining these selected rolling bays. The transfer carriages operate to laterally shift the additional bridging members into and out of their engaged positions in order to accommodate corresponding lateral shifting of rolling packages into and out of the rolling bays.

Preferably, the openings in the posts extend from the rolling line to the side of the housing structure to thereby accommodate lateral removal of a stalled product from the housing structure along with the roll packages.

Mill compactness is enhanced by at least partially supporting successive roll packages on common posts extending therebetween, thus subjecting such common posts to bi-directional stresses during rolling.

Preferably, the housing posts comprise generally C-shaped plates arranged in parallel planes located perpendicular to the rolling line.

Ideally, the spacing between the roll axes of successive roll pairs is between 1.5 to 2.0 times the maximum diameter of the work rolls being employed in the mill.

The present invention is specially adapted for, although not limited in use to, a high reduction rolling method of the type described and claimed in U.S. patent application Ser. No. 156,940 filed June 6, 1980, and assigned to the same assignee as that of the present application.

DETAILED DESCRIPTION OF INVENTION

Figure 3:
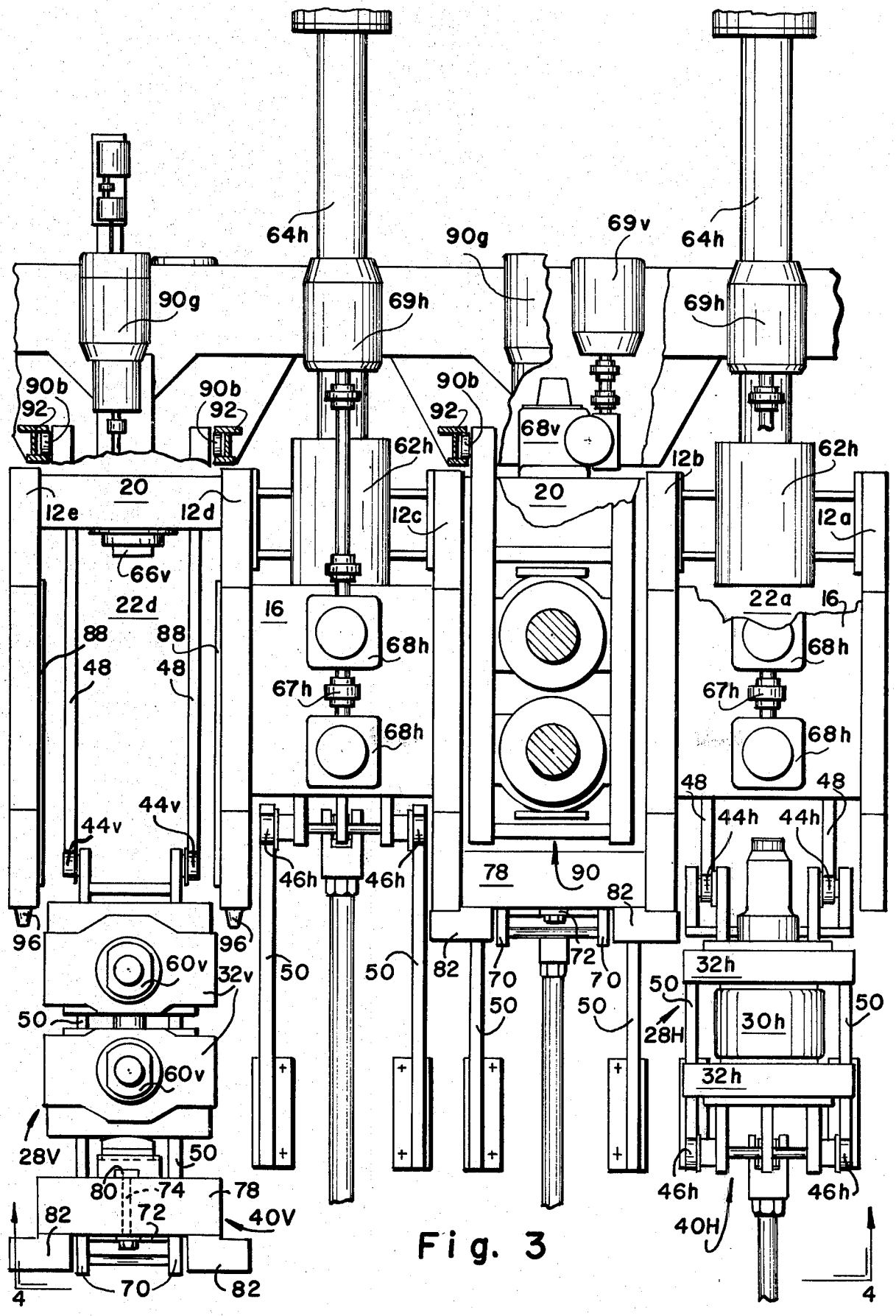
FIG. 3 is a horizontal sectional view taken along line 3—3 of FIG. 2.
Figure 4:
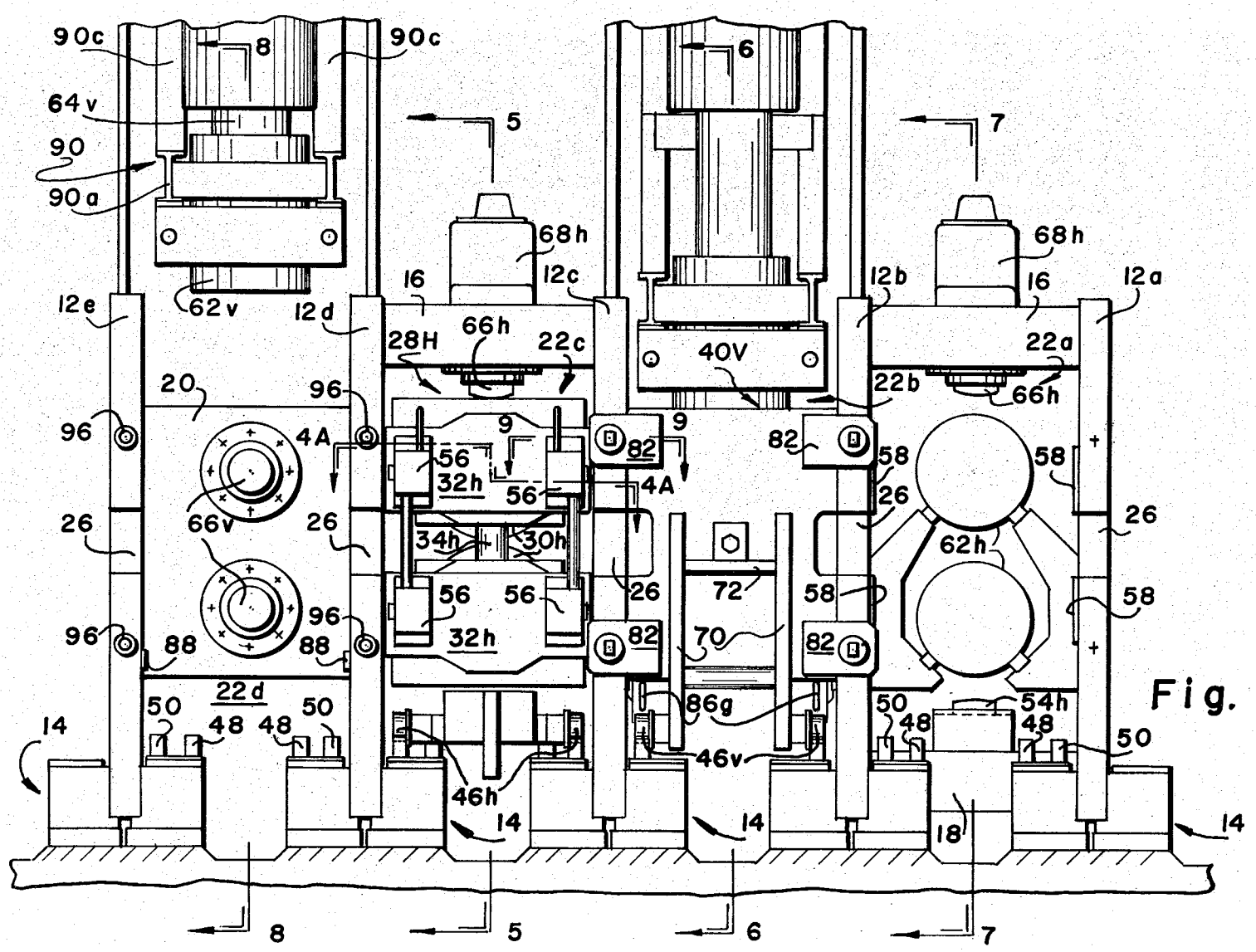
FIG. 4 is an elevational view of the work side of the mill as shown in FIG. 2.

Referring now to the drawings, a rolling mill in accordance with the present invention is shown positioned on a rolling line 10. The mill has a stationary unitized housing structure which includes a plurality of posts 12a–12e extending transversally across and spaced along the rolling line. Preferably, the posts each consist of heavy gauge generally C-shaped plates which extend in parallel planes perpendicular to the rolling line and which are firmly anchored to the mill foundation by brackets generally indicated at 14. The posts are rigidly interconnected by fixed bridging members in the following manner: upper and lower horizontally extending bridging members 16, 18 join the posts 12a, 12b and the posts 12c, 12d while on the "drive" side of the mill, vertically extending bridging members 20 join the posts 12b, 12c and the posts 12d, 12e. When viewed from right to left in FIGS. 3 and 4, i.e., in the direction of rolling, the posts 12a–12e and their respective fixed bridging members cooperate in defining rolling bays 22a–22d, with each bay having a housing window facing one side (in this case the "work" side) of the housing structure. The posts 12 are each provided with openings 26 extending thereacross from the rolling line 10 to the aforesaid windows.

The rolling bays 22a and 22c are adapted to contain operatively positioned horizontal roll packages generally indicated at 28H, whereas the rolling bays 22b, 22d are adapted to contain operatively positioned vertical roll packages 28V.

Figure 5:
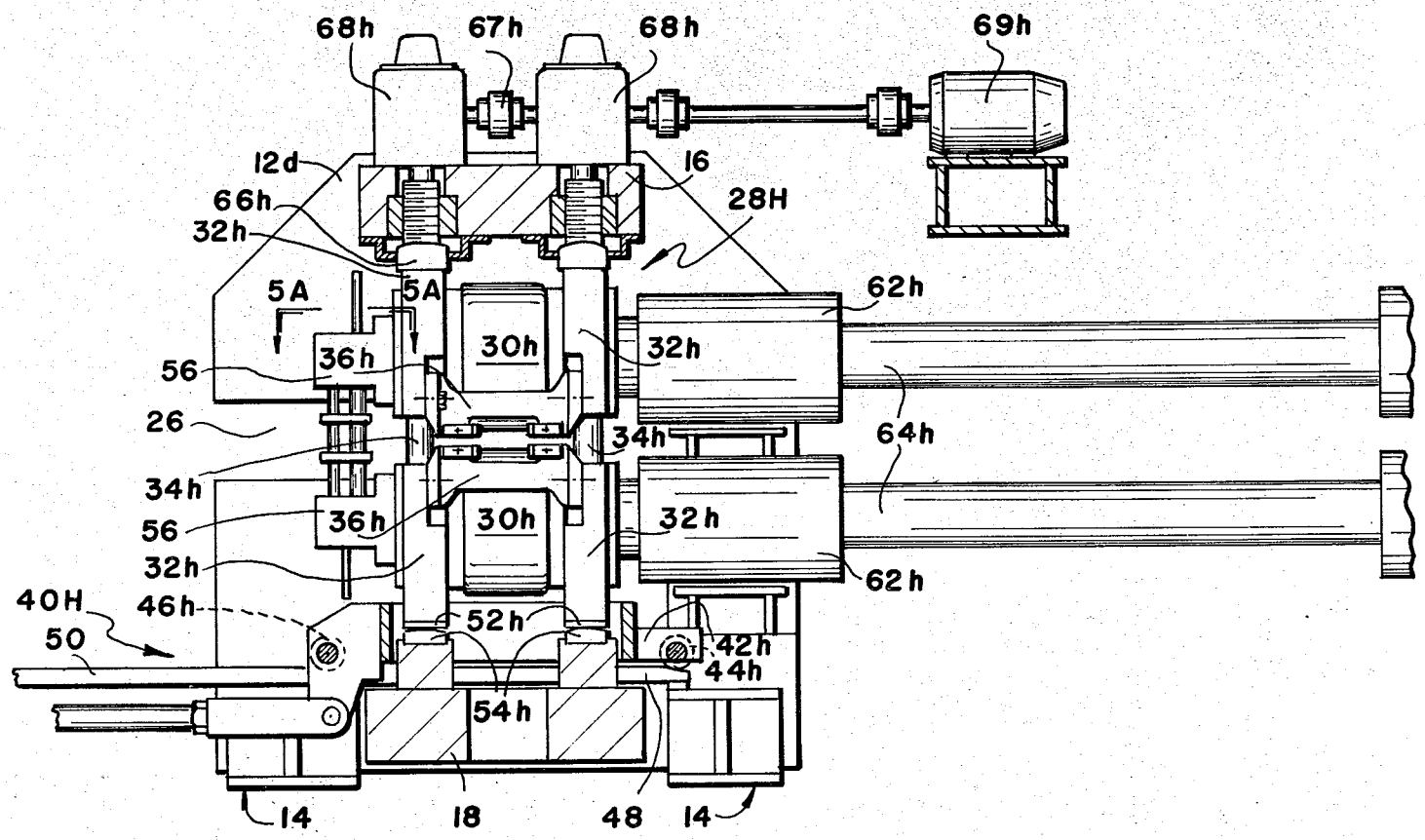
Figure 7:
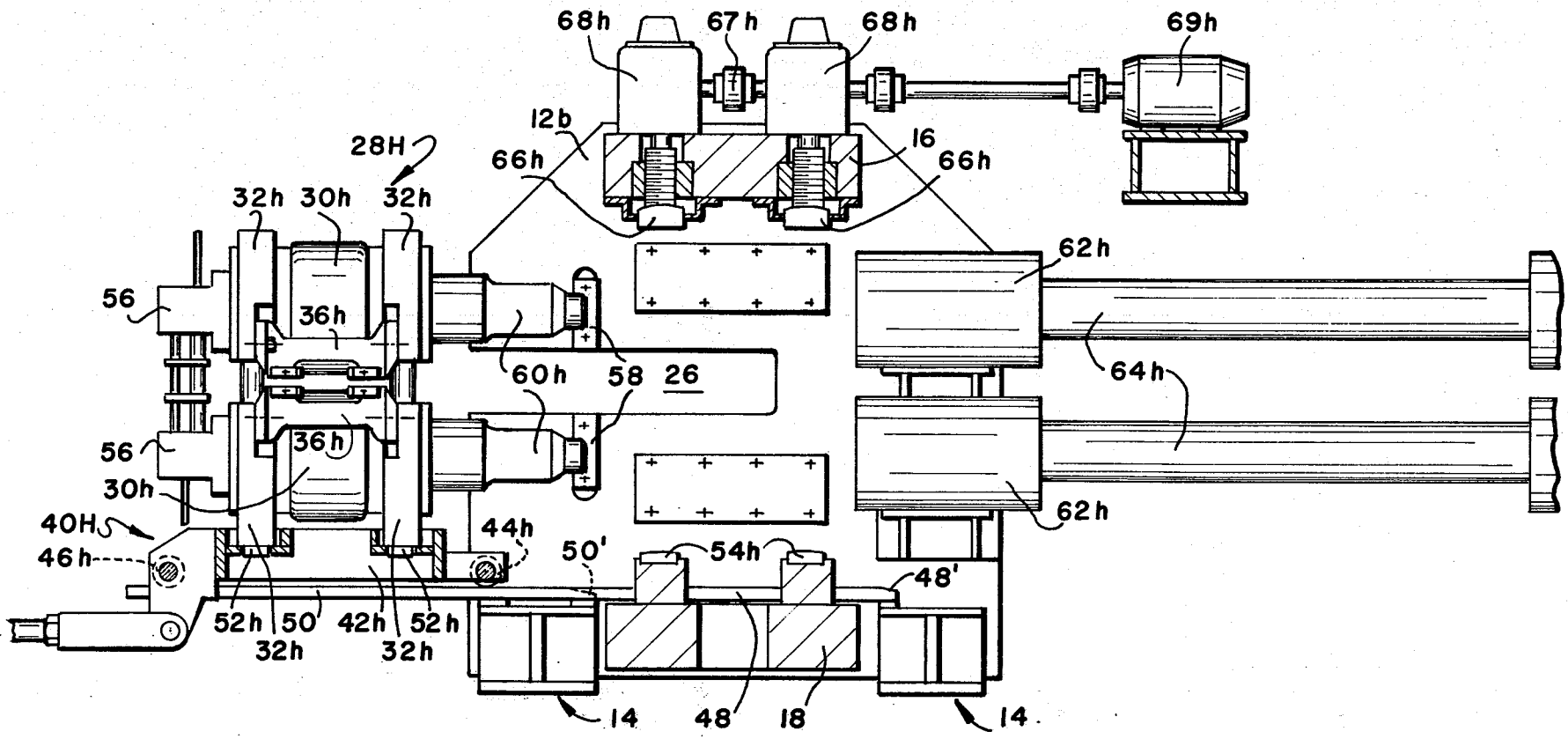
FIGS. 7, 8 and 9 are additional sectional views taken respectively on lines 7—7, 8—8 and 9—9 of FIG. 4.

As is best shown in FIGS. 5 and 7, the horizontal roll packages 28H include the following components: horizontal work rolls 30h straddle-mounted between bearings contained in bearing chocks 32h; conventional chock separators 34h arranged between the bearing chocks 32h; and split entry and delivery guides attached respectively to the entry and delivery sides of the bearing chocks 32h. In the drawings, only the entry guides 36h are shown.

Figure 6A:
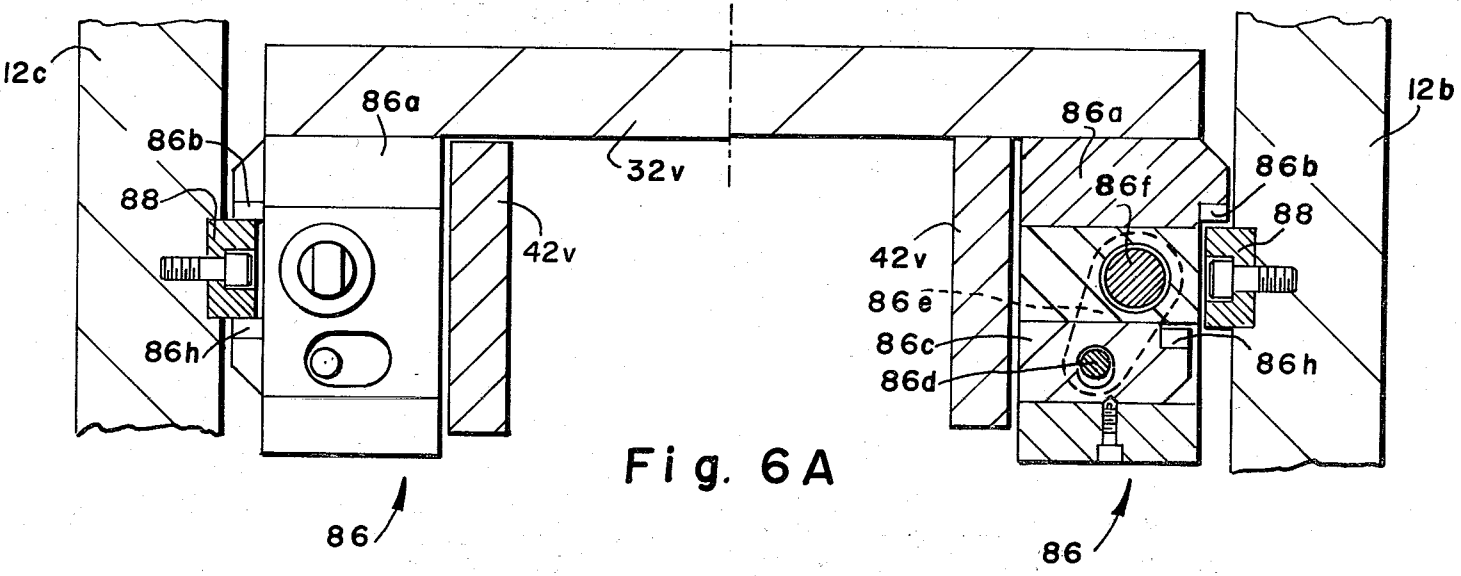
FIG. 6A is a sectional view taken along line 6A—6A of FIG. 6.
Figure 6:
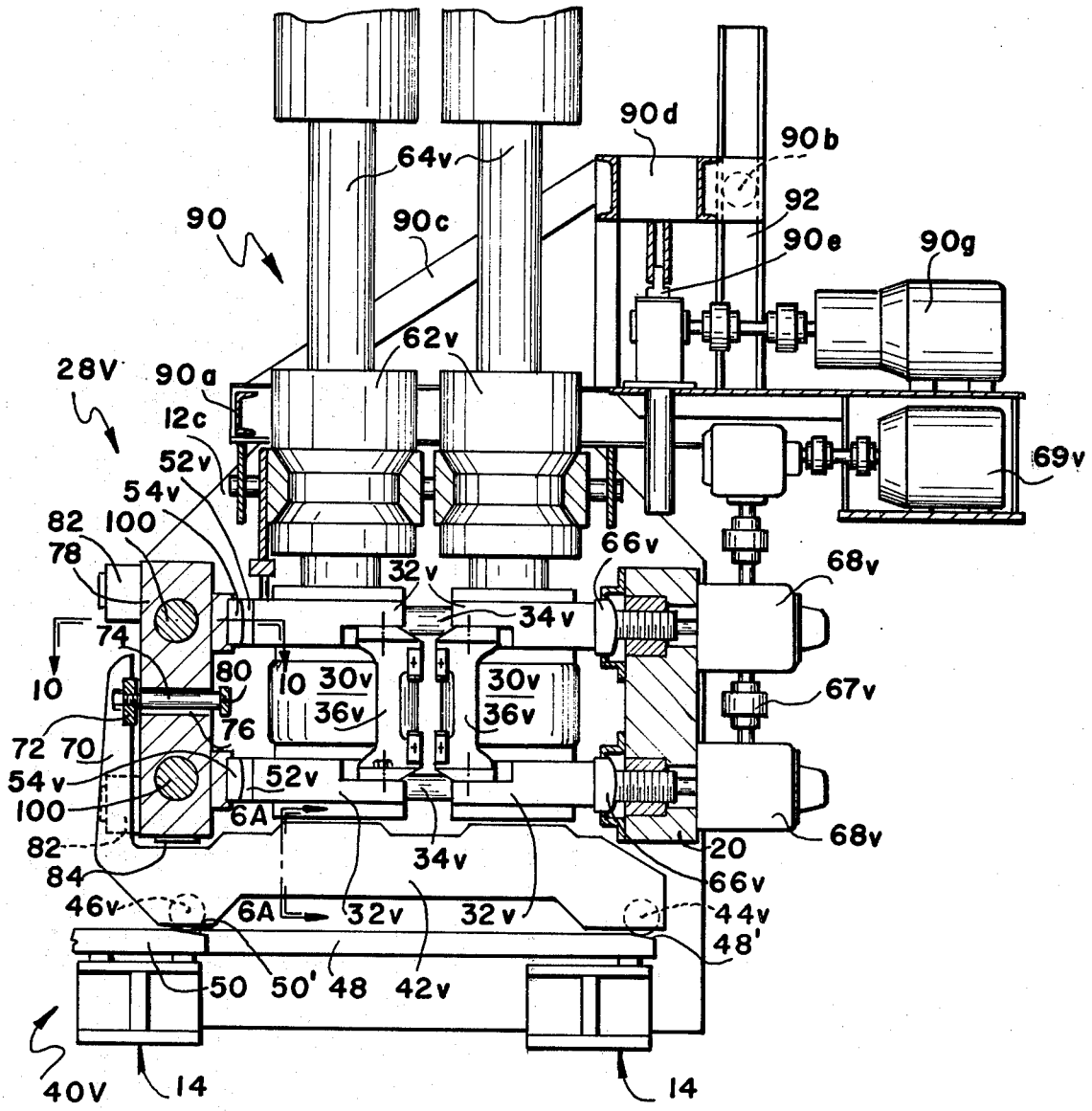
Figure 8:
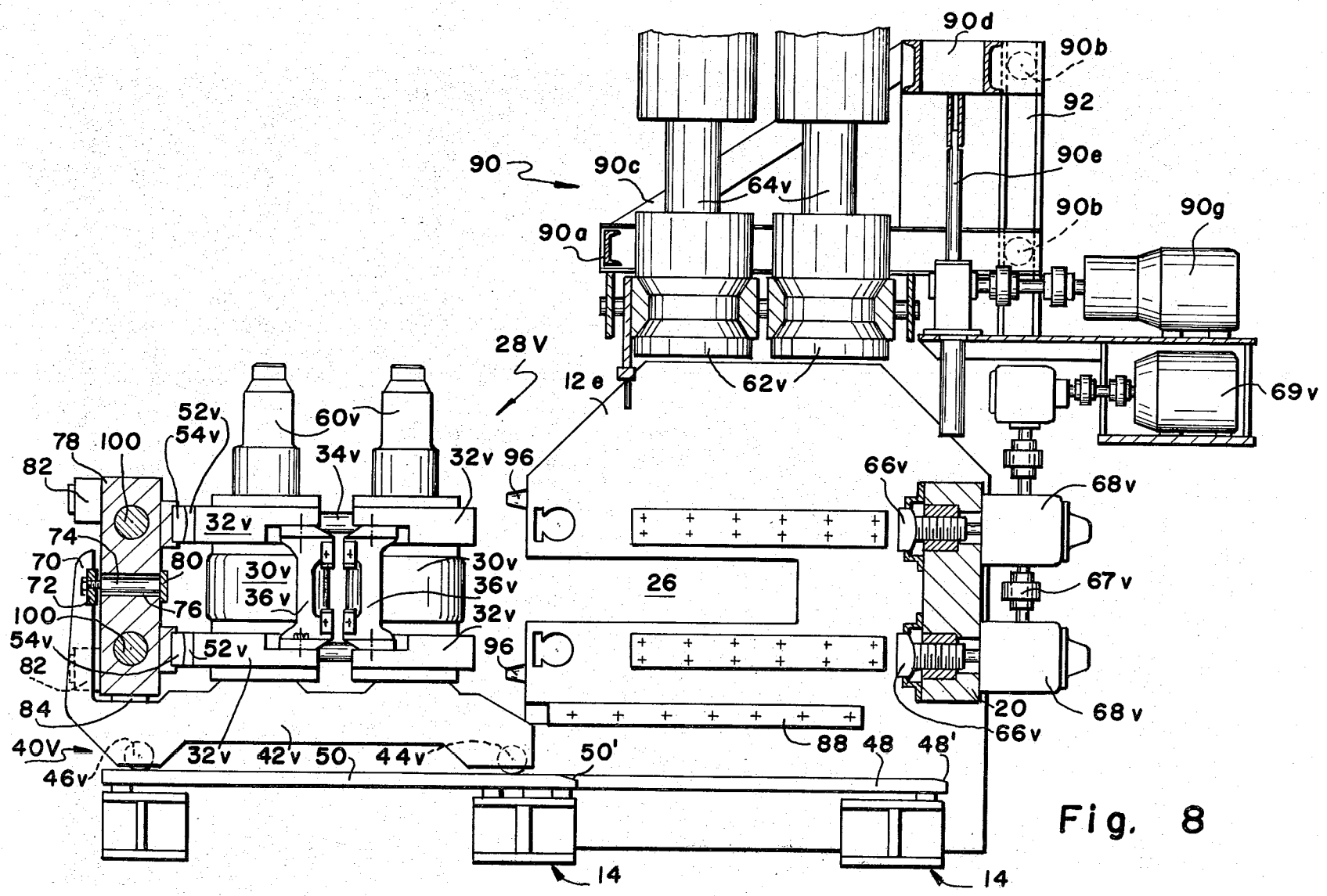

As is best shown in FIGS. 6 and 8, the vertical roll packages 28v each include similar components as follows: vertical work rolls 30v straddle-mounted between bearing chocks 32v; chock separators 34v arranged between the bearing chocks 32v; and split entry and delivery guides 36v, 38v.

Preferably, the horizontal and vertical work rolls 30h, 30v are grooveless with relatively small diameters and short barrels. By way of example, when rolling a 180×180 mm. steel billet down to 49.8×105.4 mm. round edged rectangle with four roll passes, a maximum diameter for new rolls would be in the range of 510 mm., with a roll barrel length of about 280 mm.

Figure 1:
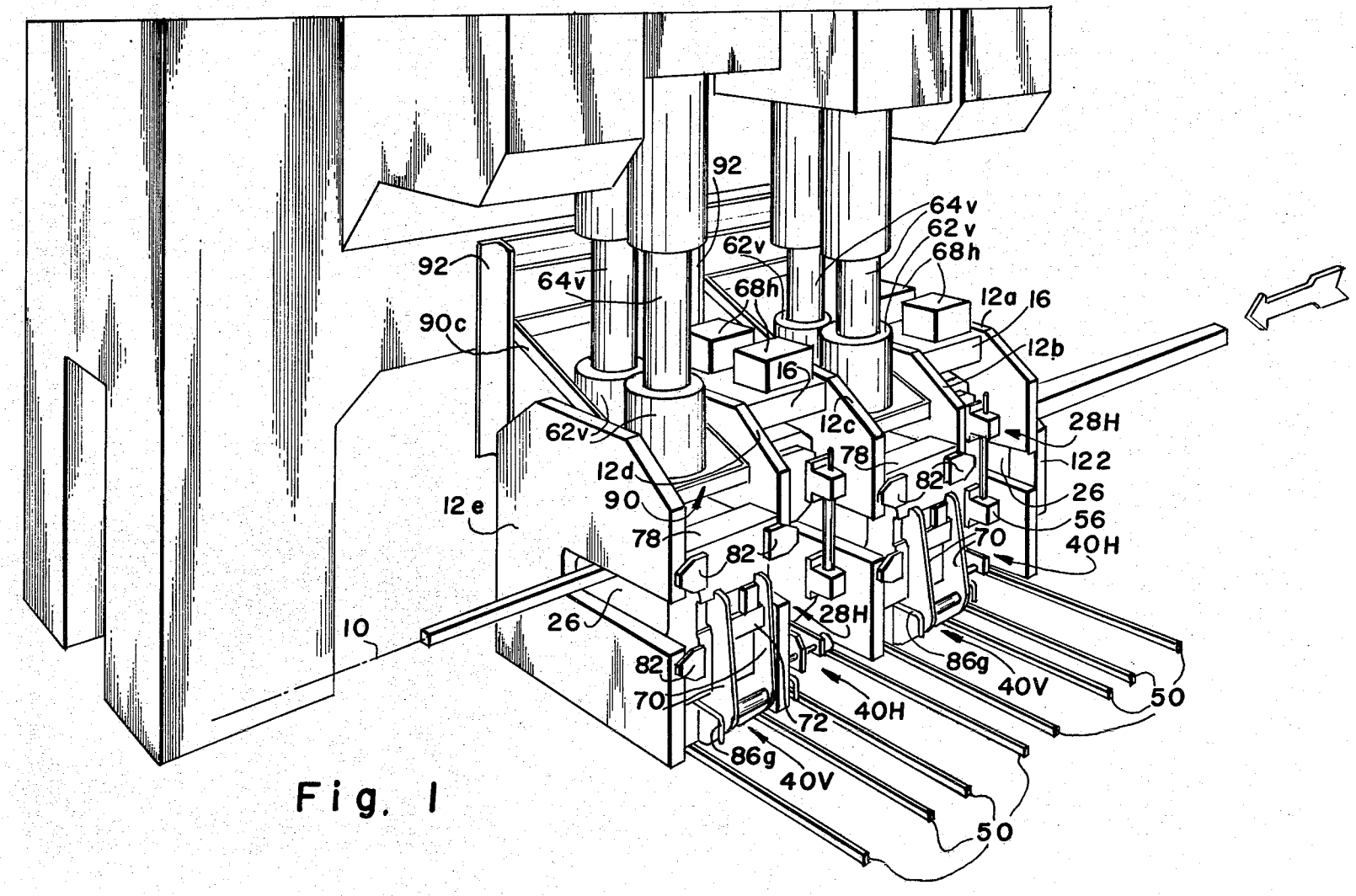
FIG. 1 is a perspective view of a compact mill in accordance with the present invention.
Figure 2:
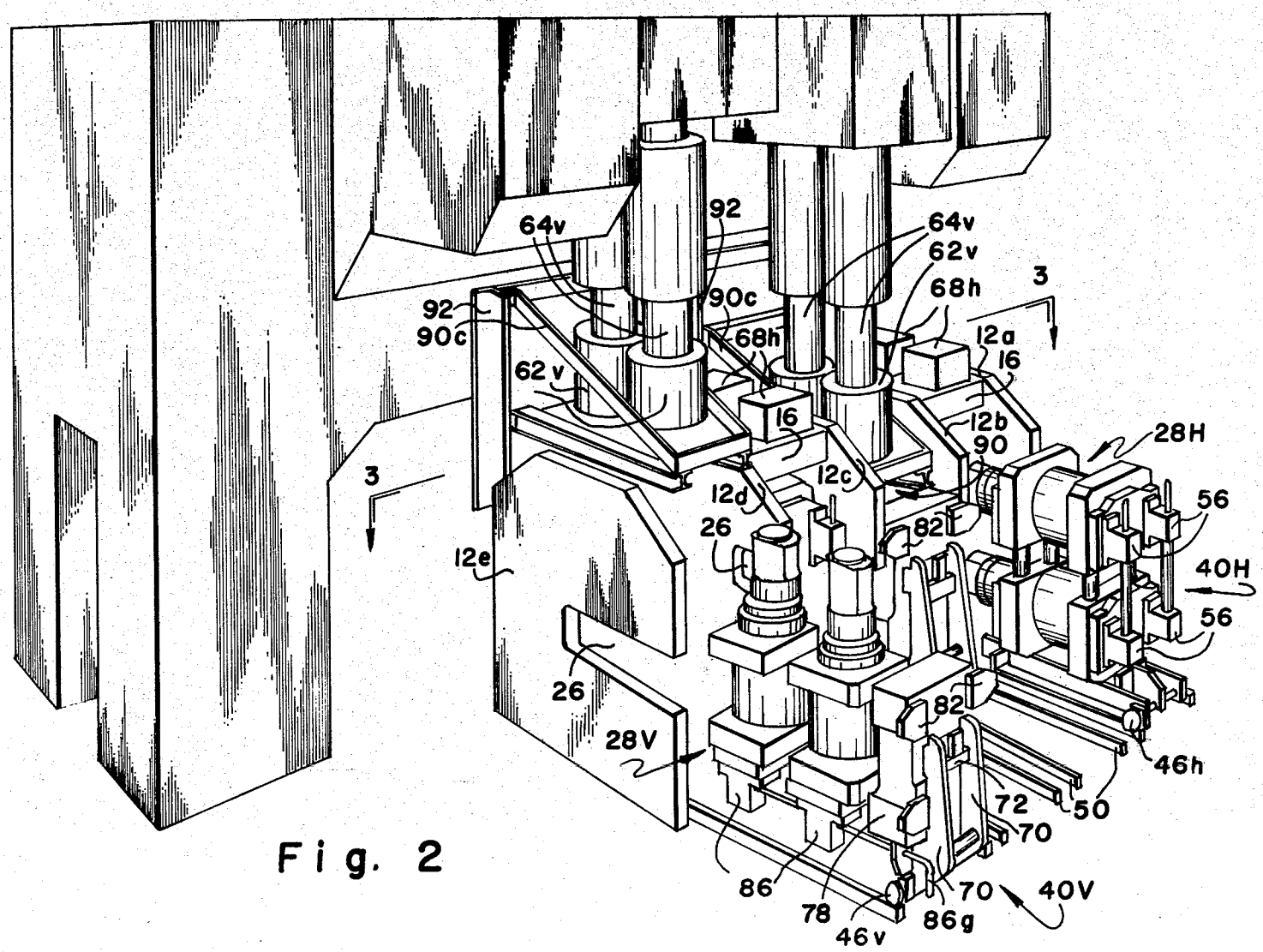
FIG. 2 is a view similar to FIG. 1, but with selected horizontal and vertical roll packages extracted laterally from the housing structure.

It will be appreciated from a comparison of FIGS. 1 and 2 that the horizontal and vertical roll packages 28H, 28V are adapted for movement in a common lateral direction between operative rolling positions located within the rolling bays 22a–22d, and inoperative extracted positions on the work side of the housing structure. This lateral movement, which takes place through the housing windows, is accomplished in the case of the horizontal roll packages 28H by means of horizontal transfer carriages indicated generally at 40H, and in the case of the vertical roll packages 28V by means of vertical transfer carriages 40V.

Referring again to FIGS. 5 and 7, it will be seen that each horizontal transfer carriage 40H includes a chassis 42h with front and rear wheels 44h, 46h. The front wheels 44h are arranged to run on tracks 48 extending across the bottom of the housing structure, and the rear wheels 46h are arranged to run along tracks 50 extending laterally away from the housing structure on the work side of the mill. When a horizontal roll package 28H is on a transfer carriage 40H and is in other than its operative rolling position, the wear plates 52h on the lower bearing chocks 32h are seated directly on the chassis 42h, as shown for example in FIG. 7. As the carriage 40H moves into its respective horizontal rolling bay, the front wheels 44h roll down inclined portions 48' of tracks 48, and at the same time the rear wheels 46h roll down inclined portion 50' of tracks 50. This lowers the carriage 40H and the horizontal roll package 28H, resulting in the wear plates 52h on the lower bearing chocks 32h being dropped directly onto the rocker plates 54h, which are in turn fixed to upstanding spaced pedestals on the lower bridging member 18.

Figure 4A:
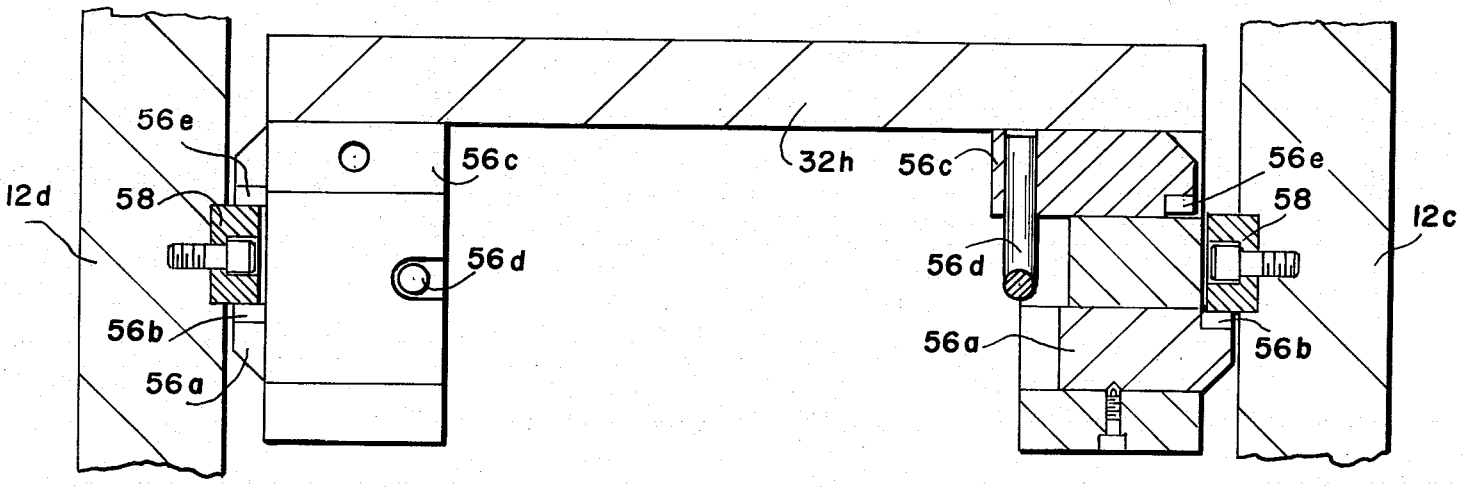
FIGS. 4A, 5 and 6 are sectional views taken respectively on lines 4A—4A, 5—5 and 6—6 of FIG. 4.

Horizontal chock lock mechanisms 56 are associated with the upper and lower horizontal bearing chocks 32h on the work side of the mill. As can be best seen in FIG. 4A, the horizontal chock lock mechanisms 56 each include laterally protruding fixed front latches 56a with noses 56b arranged to encounter short vertical keys 58 on the housing posts 12, thus establishing a limit for movement of the horizontal roll packages 28H into their respective rolling bays. Rear latches 56c are then slid laterally outwardly by means of handles 56d until their noses 56e overlap the opposite sides of the vertical keys 58. It will be understood that in FIG. 4A, the rear latch 56c on the left-hand side is shown slid outwardly into its locked position, whereas the rear latch 56c on the right-hand side is shown in its retracted unlocked position. When the rear latches 56c are all adjusted to the locked positions, the horizontal roll packages 28H are fixed against movement in the direction of the horizontal roll axes.

It is to be noted that when the rear plates 52h of the lower horizontal bearing chocks 32h rest on the rocker plates 54h, the carriage chassis 42h is no longer in contact with the horizontal roll package 28H. Consequently, the horizontal transfer carriage 40H is removed from the stress path of the mill during a rolling operation.

As each horizontal roll package enters its rolling bay, the horizontal roll shaft ends 60h enter appropriately supported coupling boxes 62h on the ends of horizontal drive spindles 64h. The spindles 64h may be driven in a conventional manner (not shown), for example by electric motors driving through reduction gear boxes located on the drive side of the mill.

After each horizontal roll package 28H is in place in its rolling bay, the upper bearing chocks 32h are contacted by the noses 66h of conventional horizontal screw-down mechanism 68h carried on the upper bridging member 16. The horizontal screw-down mechanisms 68h, which are coupled as at 67h and powered by a motor 69h, act in concert with the chock separators 34h to control horizontal roll parting.

Referring now to FIGS. 6 and 8, it will be seen that each vertical transfer carriage 40V also has a chassis 42v with front and rear wheels 44v, 46v arranged to run respectively on tracks 48 and 50, much in the same manner as that provided for the horizontal transfer carriages 40H. Each vertical transfer carriage additionally is provided, however, with upstanding arms 70 interconnected by a cross brace 72. A carrier pin 74 extends forwardly from cross brace 72 through an enlarged opening 76 in a removable bridging member 78. One end of the pin 74 is threaded and secured to the cross brace 72 by a nut. The opposite end of the pin has a foot 80 secured thereto.

Each removable bridging member 78 has laterally protruding ears 82 and downwardly facing support pads 84. When the vertical transfer carriage 40V is in other than its fully inserted position in its respective vertical rolling bay, the associated bridging member 78 is supported on the carriage by virtue of its support pads 84 resting directly on the chassis 42v, with the midsection of the bridging member being loosely contained between the cross brace 72 and the foot 80 on pin 74. When a vertical roll package 28V is on its vertical transfer carriage 40V and in other than its operative rolling position, the lowermost bearing chocks 32v also rest on the chassis 42v.

As can be best seen in FIG. 6A, the lowermost vertical bearing chocks 42v have chock lock mechanisms 86 with laterally outwardly protruding fixed latches 86a having noses 86b arranged to overlap horizontal keys 88 secured to the sides of the posts 12 facing each of the vertical rolling bays. The vertical chock lock mechanisms 86 will be described hereinafter in greater detail. The vertical rolls 30v of each vertical roll package 28v have upstanding ends 60v adapted for engagement with coupling boxes 62v at the lower ends of telescopic vertical drive spindles 64v. The vertical drive spindles may again be driven by conventional means (not shown) including electric drive motors and reduction gear boxes. Each pair of coupling boxes 64v is supported on a vertical spindle carrier generally indicated at 90.

As can be best seen in FIGS. 6 and 8, the spindle carriers 90 each include horizontal platforms 90a having guide wheels 90b arranged to run on vertical tracks 92. The platforms 90a are connected by angled supports 90c to head members 90d also provided with guide wheels 90b arranged to run on the tracks 92. The head members are in turn connected to the threaded spindles 90e of screw jacks 90f powered by motors 90g.

The screw jacks 90f operate to adjust the spindle carriers 90 and the coupling boxes 62v between lowered positions engaged with the vertical roll ends 60v as shown in FIG. 6, and raised inoperative positions as shown in FIG. 8. As previously mentioned, the vertical spindles 64v are of a telescopic design to accommodate vertical adjustment of the coupling boxes 62v. It will be understood that movement of the vertical roll packages 28V into and out of their respective rolling bays must be preceded by elevating the coupling boxes 62v to their raised inoperative positions disengaged from the roll ends 60v.

Figure 9:
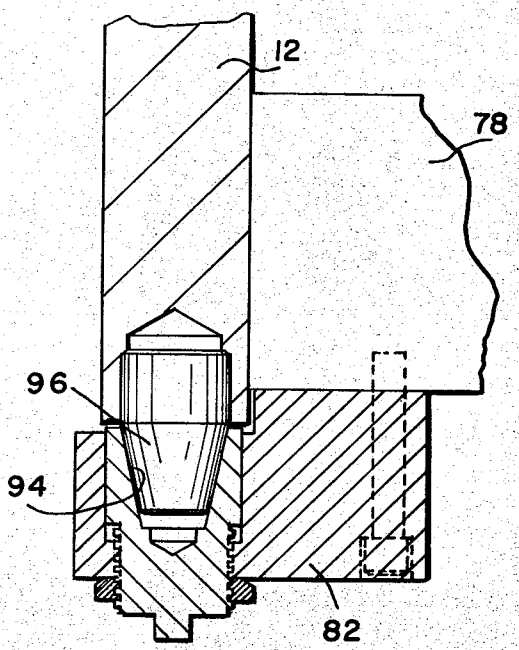

As is best shown in FIG. 9, the laterally protruding ears 82 on each removable bridging members 78 have conically tapered recesses 94 adapted to receive truncated conical pins 96 protruding from the side edges of the housing posts 12a–12e.

Figure 10:
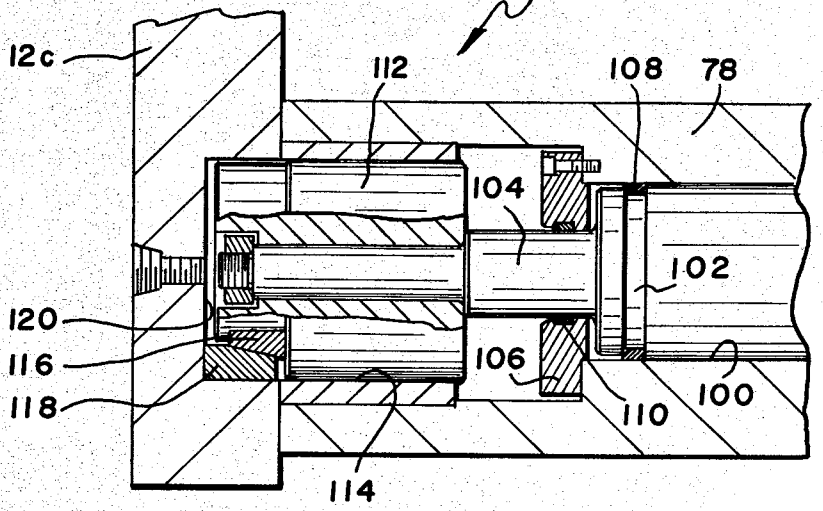
FIG. 10 is a sectional view taken along line 10—10 of FIG. 6.

The removable bridging members are additionally provided with bridge locking assemblies located adjacent to each of the ears 82. One such bridge locking assembly is shown in more detail in FIG. 10 at 98 as including a hydraulic cylinder chamber 100 extending laterally into the removable bridging member 78. The chamber 100 contains a piston 102 having a piston rod 104 extending from the piston through an annular fixed plate 106. An O-ring 108 provides a seal between the piston 102 and the wall of the chamber 100. Other O-rings 110 provide a seal between the piston rod 104 and the annular plate 106. The piston rod is connected to a cylindrical head 112 movable within an enlarged diameter passage 114 communicating with chamber 100. The head 112 carries a wedge 116 which is adapted to cooperate in frictional engagement with a wedge seat 118 mounted in a recess 120 in the housing post 12. When the wedges 116 of each bridge locking assembly are retracted into their respective chambers 114, the removable bridging member 78 is free to move relative to the housing posts. When the wedges 116 are projected laterally, they cooperate with the wedge seats 118 to force the removable bridging member 78 against the housing posts, thereby firmly seating the truncated conical pins 96 into the conical recesses 94 of the ears 82. When thus secured, the removable bridging members 78 extend across the windows of the vertical rolling bays 22b, 22d and thus provide an added rigid interconnection between housing posts 12b, 12c and housing posts 12d, 12e.

Although not shown in the drawings, it will be understood that any one of a number of hydraulic systems can be employed to power the bridge locking assemblies, including individual pump-reservoir units carried directly on the bridging members 78.

As each vertical transfer carriage 40V begins moving forwardly into its respective vertical rolling bay, the noses 86b of the fixed latches 86a on the lower bearing chocks 32v overlap the horizontal keys 88 on the adjacent housing posts. As the vertical transfer carriage continues its forward movement, the truncated conical pins 96 on the housing posts enter the conical recesses 94 in the ears 82 of the removable bridging member 78. This entry occurs at about the same time as the carriage wheels 44v, 36v begin to roll down their respective inclined track portions 48', 50'. As the vertical transfer carriage 40V drops, vertical support for the lower vertical bearing chocks 32v shifts from the carriage chassis 42v to the horizontal keys 88 on the housing posts. At approximately the same time, vertical support for the removable bridging member 78 also shifts from the carriage chassis 42v to the truncated conical pins 96. Once the vertical transfer carriage 40V has dropped away from the vertical roll package 28V, the bridge locking assemblies 98 are actuated to firmly lock the removable bridging member 78 on the pins 96 which serve as stops limiting further movement into the rolling bays. It will thus be understood that each vertical transfer carriage 40v is also removed from the housing stress path.

The fixed vertical bridging members 20 carry vertical screw-down mechanisms 68v coupled as at 67v and powered by motors 69v. The vertical screwdowns have noses 66v which are brought to bear against the chocks 32v of one vertical roll 30v (the right-hand roll as viewed in FIGS. 6 and 8). This causes the wear plates 52v on the chocks 32v of the other vertical roll to bear against rocker plates 54v carried by the removable bridging member 78.

As previously indicated, the lowermost chocks 32v of each vertical roll package 28v have vertical chock lock mechanisms 86 which include the fixed latches 86a with noses 86b overlapping the horizontal keys 88. Again with reference to FIG. 6A, it will be seen that movable latches 86c are associated with each fixed latch 86a. The movable latches 86c are connected by pins 86d to small bell cranks 86e which are carried on rotatable shafts 86f. The shafts 86f are rotatably adjusted manually by handles 86g (shown in FIGS. 1, 2 and 4) to rotate the bell cranks 86e and slide the movable latches 86c between withdrawn unlocked positions as shown on the right-hand side of FIG. 6A, and extended locked positions with their noses 86h underlying the horizontal keys 88, as shown on the left-hand side of the same view. The vertical chock lock mechanisms 86 resist axial shifting of the vertical work rolls 30*v* and their respective bearing chocks 32*v* during the rolling operation.

Once the vertical roll packages 28V are in place, the vertical spindle carriers 90 are lowered to engage the coupling boxes 62*v* on the upwardly protruding ends 60*v* on the vertical rolls 30*v*.

The opening 26 in the first housing post 12*a* is bridged at the work side of the housing by a short plate 122 (see FIG. 1) which is detachably mounted by any convenient means, for example by bolts, pins or the like (not shown).

During a rolling operation, product is sequentially rolled by the alternating horizontal and vertical pairs or rolls 30*h*, 30*v*. The distance between successive roll pairs is kept as small as possible, preferably between 1.5–2.0 times the maximum diameter of the rolls used in the mill. This compact design is made possible in part by employing single housing posts between successive roll packages.

Figure 11:
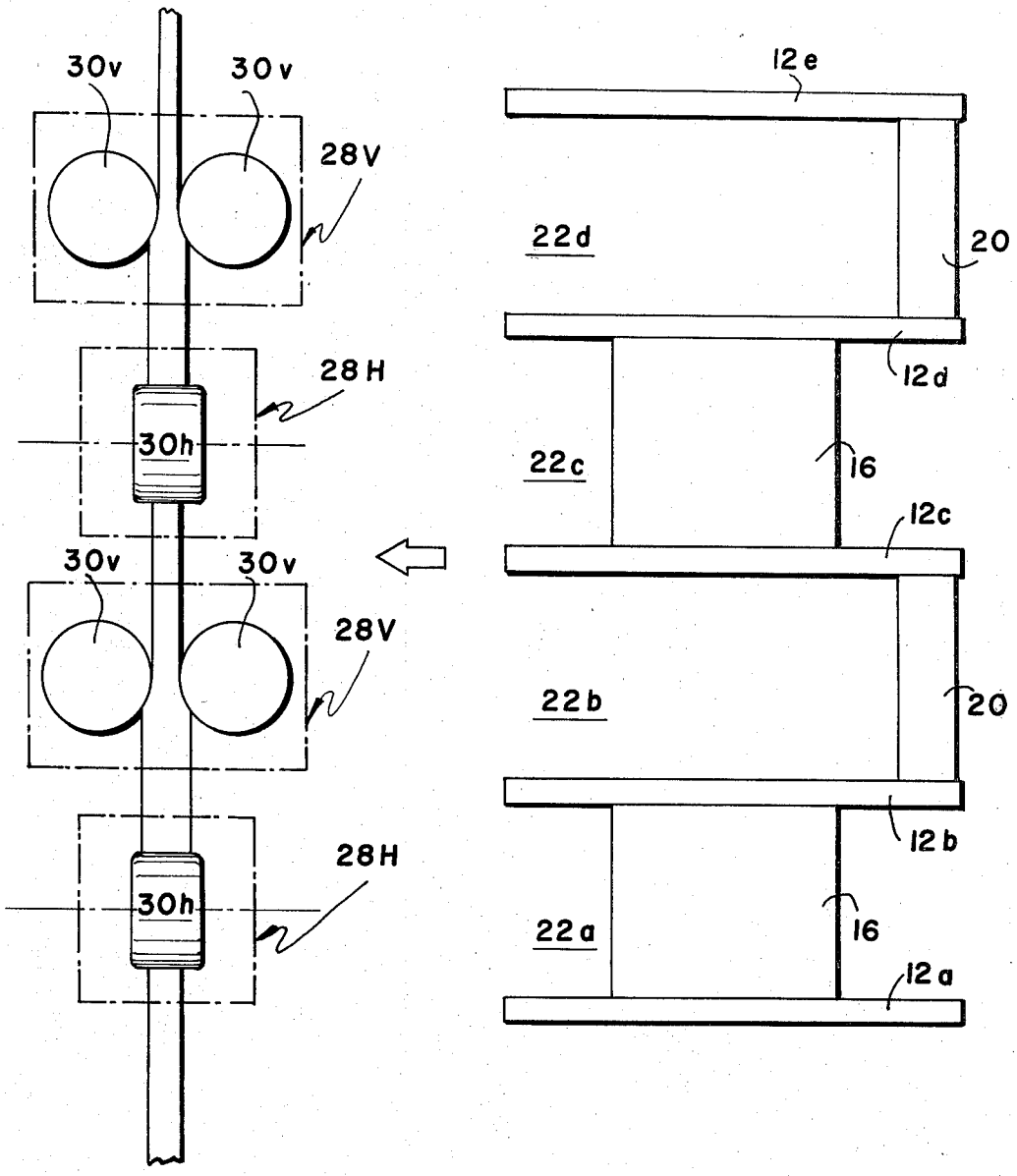
FIG. 11 is a schematic plan view of the mill with the roll packages and a stalled product extracted laterally therefrom.

In the event that a malfunction should occur, either in the mill itself, or at some downstream location, it is possible that a product length may become stalled in the mill. Should this occur, the mill will be shut down and the following action taken: the small plate 122 is detached to clear the opening 26 of the first housing post 12*a*; the vertical spindle carriers 90 are operated to elevate the coupling boxes 62*v* to the positions shown in FIG. 8; the horizontal screw down mechanisms are elevated; and the bridge locking assemblies 98 and the horizontal and vertical chock lock mechanisms 56, 86 are disengaged. Thereafter, the horizontal and vertical transfer carriages 40H, 40V together with their respective horizontal and vertical roll packages 28H, 28V are extracted laterally from the housing structure to the work side of the mill. The laterally extending openings 26 accommodate an accompanying lateral transfer of any stalled product extending through the rolling line between successive roll pairs. The extracted roll packages and accompanying stalled product are depicted schematically in plan view in FIG. 11. This provides operating personnel with enough working room to clear the stalled product by cutting it into small sections which can then be extracted from the successive roll passes. Thereafter, the roll packages are reinserted laterally into the housing structure and the mill is rapidly prepared for continued rolling by reversing the steps outlined above.

The compactness of this mill arrangement may be further appreciated by noting that with maximum roll diameters of 510 mm., the distance between successive roll passes can be limited to 975 mm., with the overall length of the mill with four roll passes being approximately 4025 mm.

We claim:

1. A rolling mill comprising:

a stationary housing structure having a plurality of posts extending transversally across and spaced along the rolling line, openings in said posts aligned with the rolling line to accommodate passage of the product being rolled, said posts being rigidly interconnected by fixed bridging members which cooperate with the posts to define a plurality of rolling bays with open windows facing one side of the housing structure;

a plurality of roll packages each including pairs of work rolls rotatably supported between bearing chocks, said roll packages being adapted for location in said rolling bays in operative rolling positions supported between said posts, with the roll axes of successive roll packages being arranged at 90° relative to each other;

means for driving the work rolls of each roll package; and transfer means for laterally shifting said roll packages through said windows between said operative rolling positions and inoperative positions located on the said one side of the housing structure.

2. The rolling mill of claim 1 further comprising removable bridging members extending across the windows of selected rolling bays, said removable bridging members being detachably secured between the posts defining said selected rolling bays and being shiftable laterally by said transfer means along with the roll packages associated with said selected rolling bays.

3. The rolling mill of claim 1 wherein said posts comprise plate members arranged in parallel planes located perpendicular to the rolling line.

4. The rolling mill of claims 1, 2 or 3 wherein the openings in said posts extend laterally from the rolling line to the windows of said rolling bays.

5. The rolling mill of claim 1 wherein successive roll packages are supported by a common post extending therebetween, the said common post thus being subjected to bidirectional roll separating forces during a rolling operation.

6. The rolling mill of claim 1 further comprising screwdown means carried on said fixed bridging members for adjusting the spacing between the rolls of said roll packages.

7. The rolling mill of claim 5 wherein the spacing between the roll axes of successive roll pairs is between 1.5–2.0 times the maximum diameter of the work rolls employed in said mill.

8. A rolling mill, comprising:

a stationary housing structure having a plurality of rigidly interconnected posts extending across the rolling line, said posts being spaced one from the other and having openings therein which are aligned with the rolling line to accommodate passage therethrough of a product being rolled, the said openings extending laterally across said posts from the rolling line to one side of the housing structure;

pairs of work rolls in operative rolling positions located between and supported at least in part by said posts, with the roll axes of successive roll pairs being arranged at 90° relative to each other;

means for driving said work rolls; and transfer means for shifting said roll pairs in a common lateral direction between said operative rolling positions and inoperative extracted positions located along the said one side of the housing structure, the said openings being arranged to accommodate any accompanying lateral extraction of product from the housing structure.

9. The rolling mill of claim 8 wherein the rigid interconnection between said posts is provided at least in part by fixed bridging members which extend between the posts at locations other than at the said one side of the housing structure.

10. The rolling mill of claim 9 wherein the rigid interconnection between said posts is additionally provided by removable bridging members extending between and detachably engaged with selected pairs of said posts at the said one side of the housing structure.

11. The rolling mill of claim 10 wherein said removable bridging members are adapted to be laterally shifted by said transfer means into and out of engagement with said selected pairs of posts.

12. The rolling mill of claims 8, 9, 10 or 11 wherein said transfer means comprises a plurality of track-mounted carriages.

13. The rolling mill of claim 8 wherein at least some of said posts provide support for two successive roll pairs, and are thus subjected to bidirectional stresses during rolling.

14. The rolling mill of claim 8 wherein said work rolls are grooveless.

15. A rolling mill, comprising:

a housing structure having a plurality of fixed posts extending transversally across and spaced along the rolling line, said posts consisting of generally C-shaped plate members with openings therein extending from the rolling line to one side of the housing structure, and with fixed bridging members rigidly interconnecting said posts and cooperating therewith to define a plurality of rolling bays with open windows facing the said one side of the housing structure;

a plurality of roll packages each including pairs of work rolls rotatably supported between bearing chocks, said roll packages being adapted for location in said rolling bays in operative rolling positions supported between said posts with the roll axes of successive roll packages being arranged at 90° relative to each other, and with at least some of the successive roll packages being partially carried by a common post extending therebetween;

means for driving the work rolls of each roll package; and transfer means for laterally shifting said roll packages through said windows between said operative rolling positions and inoperative retracted positions on the said one side of the housing structure.

* * * * *